US005362366A

United States Patent [19]

de Nora et al.

[11] Patent Number: 5,362,366

[45] Date of Patent: Nov. 8, 1994

[54] ANODE-CATHODE ARRANGEMENT FOR ALUMINUM PRODUCTION CELLS

[75] Inventors: Vittorio de Nora, Nassau, Bahamas; Jainagesh A. Sekhar, Cincinnati, Ohio

[73] Assignee: Moltech Invent S.A., Luxembourg

[21] Appl. No.: 874,752

[22] Filed: Apr. 27, 1992

[51] Int. Cl.[5] ..... C25C 3/06; C25C 3/08

[52] U.S. Cl. ..... 204/67; 204/225; 204/245; 204/244; 204/280

[58] Field of Search ..... 204/280, 243 R, 284, 204/291, 245, 292, 293, 290 R, 294, 67, 244

[56] References Cited

U.S. PATENT DOCUMENTS

| | | | |
|---|---|---|---|
| 4,397,729 | 8/1983 | Duruz et al. | 204/243 |
| 4,560,448 | 12/1985 | Sane et al. | 204/67 |
| 4,596,637 | 6/1986 | Kozarek et al. | 204/67 |
| 4,614,569 | 9/2986 | Duruz et al. | 204/67 |
| 4,678,548 | 7/1987 | Brown | 204/67 |
| 4,680,094 | 7/1987 | Duruz | 204/290 R |
| 4,681,671 | 7/1987 | Duruz | 204/67 |
| 4,865,701 | 9/1989 | Beck et al. | 204/244 |

FOREIGN PATENT DOCUMENTS

| | | |
|---|---|---|
| 0126555 | 11/1984 | European Pat. Off. . |
| 0132031 | 1/1985 | European Pat. Off. . |
| 0308013 | 3/1989 | European Pat. Off. . |
| 0308015 | 3/1989 | European Pat. Off. . |
| 8906289 | 7/1989 | WIPO . |

*Primary Examiner*—Kathryn Gorgos
*Attorney, Agent, or Firm*—Frost & Jacobs

[57] ABSTRACT

A novel anode-cathode arrangement for the electrowinning of aluminum from alumina dissolved in molten sales, consisting of an anode-cathode double-polar electrode assembly unit or a continuous double polar assembly in which the anode and cathode are bound together and their interelectrode gap is maintained substantially constant by connections made of materials of high electrical, chemical, and mechanical resistance. Novel, multi-double-polar cells for the electrowinning of aluminum contain two or more of such anode-cathode double-polar electrode assembly units. This arrangement permits the removal of reimmersion into any of the anode-cathode double-polar electrode assembly units during operation of the multi-double-polar cell whenever the anode and or the cathode or any part of the electrode unit needs reconditioning for efficient cell operation.

48 Claims, 2 Drawing Sheets

ANODE-CATHODE ARRANGEMENT FOR ALUMINUM PRODUCTION CELLS

FIELD OF THE INVENTION

The present invention concerns a new and improved electrode assembly system or unit for electrolytic cells used for electrolysis in molten salts, especially for electrolysis of alumina dissolved in molten cryolite.

BACKGROUND OF THE INVENTION

The technology for the production of aluminum by the electrolysis of alumina, dissolved in molten cryolite containing sales, at temperatures around 950° C. is more than one hundred years old.

This process, conceived almost simultaneously by Hall and Heroult, has not evolved as many other electrochemical processes. It is difficult to understand why, despite the tremendous growth in the total production on aluminum that in fifty years has increased almost one hundred fold, the process and the cell design have not undergone any great change or improvement.

The electrolytic cell trough is typically made of a steel shell provided with an insulating lining of refractory material covered by anthracite-based carbon blocks at the wall and at the cell floor bottom which acts as cathode and which the negative pole of a direct current source is connected by means of steel conductor bars embedded in the carbon blocks.

The anodes are still made of carbonaceous material and must be replaced every few weeks. The operating temperature is still approximately 950° C. in order to have a sufficiently high alumina solubility and rate of dissolution which decreases rapidly at lower temperatures.

The carbonaceous materials used in Hall-Heroult cells as the anode and as the cell lining are certainly not ideal for resistance under the existing adverse operating conditions.

The anodes have a very short life because during electrolysis the oxygen which should evolve on the anode surface combines with the carbon to form $CO_2$ and small amounts of CO. The actual consumption of the anode is approximately 450 Kg/Ton of aluminum produced which is more than ⅓ higher than the theoretical amount of 335 Kg/Ton corresponding to that of the stoichiometric reaction.

The carbon lining of the cathode bottom has a useful life of a few years after which the operation of the entire cell must be shopped and the cell relined at great cost. In spine of an aluminum pool having a thickness of more than 20 mm maintained over the cathode, the deterioration of the cathode carbon blocks cannot be avoided because of penetration of cryolite and liquid aluminum, as well as intercalation of sodium ions which causes swelling and deformation of the cathode carbon blocks and displacement of such blocks.

In addition, when cells are rebuilt, there are problems of disposal of the carbon which contains toxic compounds including cyanides.

The carbon blocks of the cell wall lining do not resist attack by cryolite, and a layer of solidified cryolite has to be maintained on the cell wall to extend its life.

The major drawback, however, is due to the fact that irregular electromagnetic forces create waves in the molten aluminum pool and the anode-cathode distance (ACD), also called interelectrode gap (IEG), must be kept at a safe minimum value of approximately 50 mm to avoid short circuiting between the cathodic aluminum and the anode.

The high electrical resistivity of the electrolyte, which is about 0.4 Ohm.cm., causes a voltage drop which alone represents more than 40% of the total voltage drop with a resulting energy efficiency which reaches only 25% in the most modern cells.

The high increase of the cost of energy, which has become even a bigger item in the total manufacturing cost of aluminum since the oil crisis, has decreased the rate of growth of this important metal.

In the second largest electrochemical industry following aluminum, namely the chlorine and caustic industry, the invention of dimensionally stable anodes (DSA ®) which were developed around 1970 permitted a revolutionary progress in chlorine cell technology resulting in a substantial increase in cell energy efficiency, in cell life and in chlorine caustic purity.

The substitution of graphite anodes with DSA ® increased drastically the life of the anodes and reduced substantially the cost of operating the cells. The rapid increase in chlorine caustic growth was stopped only by ecological concerns.

In the case of aluminum production, pollution is not due to the aluminum produced, but to the materials used in the process and to the primitive cell design and operation which have remained the same over the years.

Progress has been made in the operation of modern plants which utilize cells where the gases emanating from the cells are in large part collected and adequately scrubbed and where the emission of highly polluting gases during the manufacture of the carbon anodes is carefully controlled.

However, the frequent substitution of the anodes in the cells is still a clumsy, unpleasant and expensive operation. This cannot be avoided or greatly improved due to the size and weight of the anode and the fact that the cathode is formed by the cell floor and is not removable during cell operation. Recently, progress has been made in the anode and the cathode composition, primarily with the development of non-carbon, substantially non-consumable anodes (NCA) and cathodes (NCC). The life of these NCA and NCC is nevertheless limited and even these electrodes need occasional replacement or reconditioning.

BACKGROUND ART

U.S. Pat. No. 4,560,448—Sane et al discloses a recent development in molten salt electrolysis cells concerning making materials wettable by molten aluminum. However, the carbon or graphite anodes are of conventional design with no suggestion leading to the present invention.

U.S. Pat. No. 4,681,671—Duruz illustrates another improvement in molten salt electrolysis wherein operation at lower than usual temperatures is carried out utilizing permanent anodes, e.g. metal, alloy, ceramic or a metal-ceramic composite as disclosed in European Patent Application No. 0030834 and U.S. Pat. No. 4,397,729. While improved operation is achieved at lower temperatures, there is no suggestion of the subject matter of the present invention.

PCT Application WO 89/06289—La Camera et al. deals with molten salt electrolysis wherein attention is directed to an electrode having increased surface area. However, again, there is no disclosure leading to the present invention.

The following references disclose several other proposals to improve cell operation:

European Patent Application No. 0308015 de Nora discloses a novel current collector;

European Patent Application No. 0308013 de Nora deals with a novel composite cell bottom; and European Patent Application No. 0132331 Dewing provides a novel cell lining.

While the foregoing references indicate continued efforts to improve the operation of molten cell electrolysis operations, none deal with or suggest the present invention.

SUMMARY OF THE INVENTION

This invention aims to overcome problems inherent in the conventional operation of electrolysis cells used in the production of aluminum via electrolysis of alumina dissolved in molten cryolite.

The invention permits more efficient cell operation particularly by modifying the electrode configuration, the materials of construction, and by utilizing a multi-double-polar cell employing a new method of operating the cell by means of the removal and reimmersion of an anode-cathode double-polar electrode assembly system which, according to the invention, forms a single assembly. This assembly can be removed from the cell as a unit whenever the anode and/or cathode or any part of the electrode assembly unit needs reconditioning for good cell operation.

The invention proposes a single anode-cathode double polar electrode assembly system or unit including at least two assembly units of anodes and cathodes connected to a single source of electrical direct current, the assembly system being immersible, removable and reimmersible as such into the molten electrolyte during operation of the electrolysis cell.

In particular the invention concerns an anode-cathode double-polar electrode assembly forming an anode-cathode electrode assembly system or unit of a new configuration to be utilized in multi double polar cells or continuous double-polar configurations for the production of aluminum, by the electrolysis of alumina dissolved in cryolite based molten salts.

In this assembly, the anode and cathode materials are electrically conductive and their surface or coating ms resistant to the electrolyte and to the respective products of electrolysis. The anode-cathode gap is maintained substantially constant, and the anode and the cathode are held together by means of connection elements made of material of high electrical, chemical and mechanical resistance, thus, permitting the removal from and reimmersion in the molten electrolyte of a double-polar electrode assembly unit during operation of the multi double-polar cell for the production of aluminum whenever the anode and/or the cathode or any part of the electrode assembly unit may need reconditioning for efficient cell operation.

In the anode-cathode double-polar electrode assembly units, the anode and the cathode surfaces may be substantially parallel in configuration whereby the current density across the gap is completely balanced. On the other hand, the anode-cathode gap may slightly be changed along a line at a 90° angle with respect to the current path in order to balance the voltage drop in different current paths and so as maintain a more uniform current density over the entire active surface area of the electrodes. The lines of current path may of course be changed to be at any angle to the horizontal or vertical directions, i.e. substantially vertical, substantially horizontal or at an angle with the vertical.

The invention contemplates using a package, i.e., a plurality of spaced apart anodes and cathodes connected by suitable electrically insulating means such as a bar or insulating layer. The number of anode-cathode combinations in a package can be varied as desired; generally from 4 to 100 are considered practical.

The electrical contacts in such double-molar electrode assembly units or packages may take on different configurations. For example the electrical contacts no the anode and cathode of the double-polar electrode assembly unit may be both made from the top of the multi double-molar cell or the electrical contact to the anode of the double-polar electrode assembly unit may be made from the top and that to the cathode may be made from the bottom.

In the double-polar electrode assembly unit, the anodes may be made of porous material for greater active surface area and better evolution of the gas produced.

Similarly, the double-polar electrode assembly unit may contain cathodes made of porous materials for better drainage of the aluminum produced. In fact, porous materials may be used for the anodes, the cathodes, and/or for the non-conductive connections for better chemical and mechanical resistance.

Advantageously, the gas evolution and its guided displacement is utilized for better electrolyte circulation in the space between the anode and cathode active surfaces, Additionally, the anodes of the anode-cathode double-polar electrode assembly unit may be made from non-carbon, substantially non-consumable refractory materials resistant to the electrolyte, to the oxygen produced, and to other gases, vapors, and fumes present in the cell. Such refractory materials normally may be selected from the group consisting of metals, metal alloys, intermetallic compounds and metal-oxyborides, oxides, oxyfluorides, ceramics, cermets, and mixtures thereof. The anode materials may also be made from metals, metal alloys, intermetallic compounds and/or metal-oxycompounds which contain primarily at least one of nickel, cobalt, aluminum, copper, iron, manganese, zinc, tin, chromium and lithium and mixtures thereof. Oxides and oxyfluorides, borides, ceramics and cermets which contain primarily at least one of zinc, tin, titanium, zirconium, tantalum, vanadium, lithium, cerium, iron, chromium, nickel, cobalt, copper, yttrium, lanthanides, and Misch metals and mixtures thereof may be also used. Adherent refractory coatings may be coated on anodes comprising an electrically conductive structure.

The cathodes may be made of or coated with an aluminum-wettable refractory hard metal (RHM) with little or no possibility of molten cryolite attack. The refractory hard material may be a borides of titanium, zirconium, tantalum, chromium, nickel, cobalt, iron, niobium, and/or vanadium. Thus, the cathode may comprise a carbonaceous material, refractory ceramic, cermet, metal, metal alloy, intermetallic compound or metal-oxycompound having an adherent refractory coating made of an aluminum-wettable refractory hard metal (RHM). The carbonaceous material could be a anthracite based material or carbon or graphite.

Doping agents may be added to the anode and cathode materials to improve their density, electrical conductivity, chemical and electrochemical resistance and other characteristics.

All the materials mentioned above may be made by micropyretic reactions described in an earlier U.S. patent application Ser. No. 07/861,513 (ref. MOL0508, filed Apr. 1st 1992) whose contents are incorporated herein by way of reference.

The connections utilized to bind the anode to the cathode to form a single or multiple double-polar anode-cathode electrode assembly may be made of any suitable electrically non-conductive material resistant to the electrolyte and the products of electrolysis. These include silicon nitride, aluminum nitride and other nitrides as well as alumina and other oxides, and oxynitrides.

Micropyretic reactions starting from slurries may become the methods of making the anode-cathode double-molar electrode assembly systems. The slurries may contain reactant and non-reactant fillers. The non-reactant fillers may contain particulate powders made of materials obtainable by the micropyretic reaction.

Micropyretic methods may be utilized to form the double polar or multi-double polar assemblies in a single operation.

Multi-double polar cells and packages are also contemplated containing two or more anode-cathode double polar single electrode assembly units. The multi-double-polar cells could have plates, cylinders or rods to optimize the voltage efficiency and work within the current density limitations of the materials being used. For instance, the anodes can be substantially cylindrical hollow bodies and the cathodes can be rods placed inside such bodies. As stated before, porous materials may be employed. Methods of operating such cells are also envisaged with various configurations of anodes and cathodes in rod, V or cylindrical formation. For instance, the anodes can have the shape of an inverted V and the cathodes have the shape of a prism placed inside the anodes.

All the assemblies are contemplated to be environmentally superior to current designs as the amount of $CO_2$ and CO emissions are minimized to avoid pollution problems which disturb the atmosphere and which delay the growth or production of aluminum. Computer monitoring of electrode gaps is also envisaged. All the assemblies described herein are expected to be immersible, removable and reimmersible in the electrolyte. A continuous replacement strategy for the electrodes is also envisaged.

BRIEF DESCRIPTION OF THE DRAWINGS

Reference is made to the drawings wherein.

DETAILED DESCRIPTION

Figure 1:
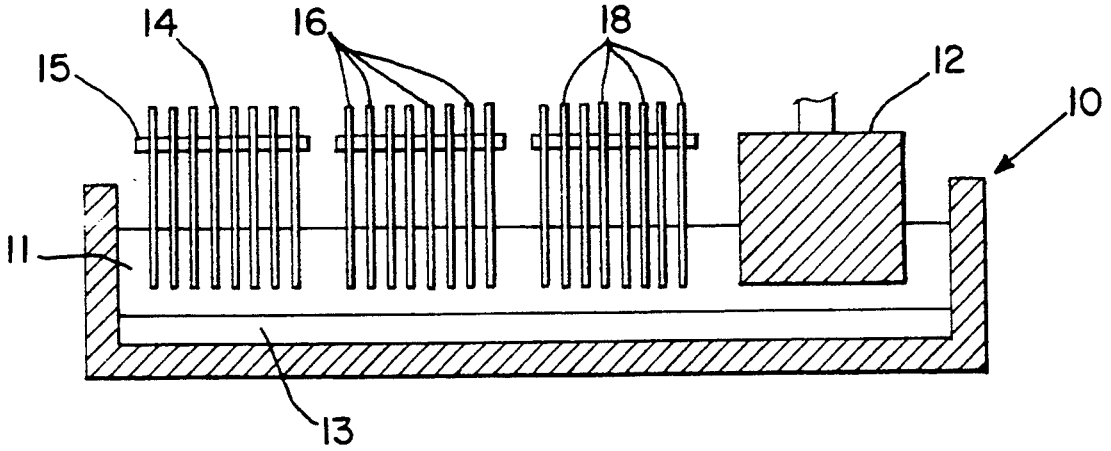
FIG. 1 is a schematic drawing of a molten salt electrolysis cell illustrating both a conventional anode and packages of anodes and cathodes employing this invention.

Referring to the drawings, in FIG. 1, there is shown an electrolytic cell 10 containing molten cryolite 11 and aluminum 13 and containing both a conventional pre-baked carbon anode 12 as well as three removable anode-cathode packages 14 of this invention comprising alternate anodes 16 and cathodes 18 held in spaced-apart relationship by a transverse electrically insulating bar 15. The anodes and cathodes can be closely spaced to improve cell voltage and energy efficiency and overall good cell operating conditions. The anode-cathode removable units or packages 14 offer substantially greater electrochemical active surfaces compared to currently employed anodes such as 12. Moreover, the electrically insulating bar 15 can be designed to be continuously adjustable to insure optimum distance and best performance.

Figure 2:
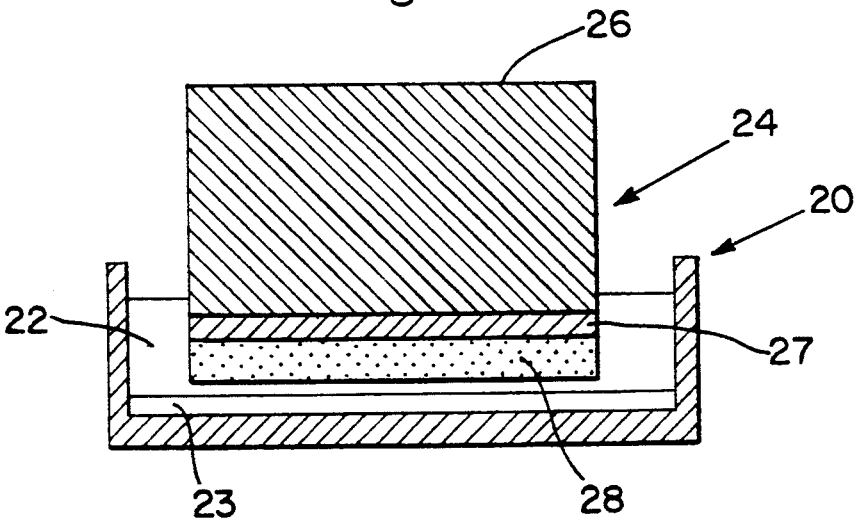
FIG. 2 is a schematic drawing of an anode-cathode double polar cell utilizing a porous cathode.

In FIG. 2, there is shown an anode-cathode double polar cell 20 containing molten cryolite 22, aluminum 23 and an anode-cathode assembly system 24 consisting of an anode 26 and a porous cathode 28 separated by mechanically strong electrically insulating material 27 resistant to attack by molten cryolite. The pieces of materials 27 serve both as means for suspending the porous cathode 28 and as spacers leaving between the facing anode and cathode surfaces a space containing the electrolyte. Alternatively, the insulating material 27 could form a porous diaphragm with pores of sufficient size. Electrolysis circulation can be induced in the anode-cathode gap. In operation, cathodically-produced aluminum drips through the pores in cathode 28, and drips into the pool aluminum 23.

Figure 3:
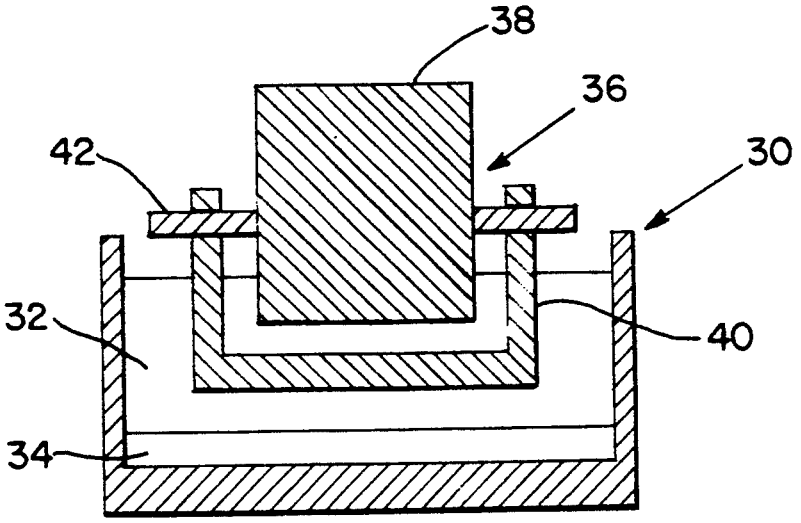
FIG. 3 is a schematic drawing of another form of double polar cell utilizing a porous cathode.

A preferred anode-cathode double polar electrode assembly is as set forth in FIG. 3. In FIG. 3, there is shown an anode-cathode double polar cell 30 containing molten cryolite 32 and molten aluminum 34. The anode-cathode double polar single electrode assembly 36 includes an anode 38 and a porous cathode 40. One or more horizontal insulating bars 42 separates the anode 38 and cathode 40, the cathode 40 having a U-section as shown and being suspended from the insulating bar(s) 42. Note that the insulating bar 42 holding the anode 38 and cathode 40 together is above the cryolite. The cathode 40 also may be formed of materials containing a plurality of holes.

Figure 4:
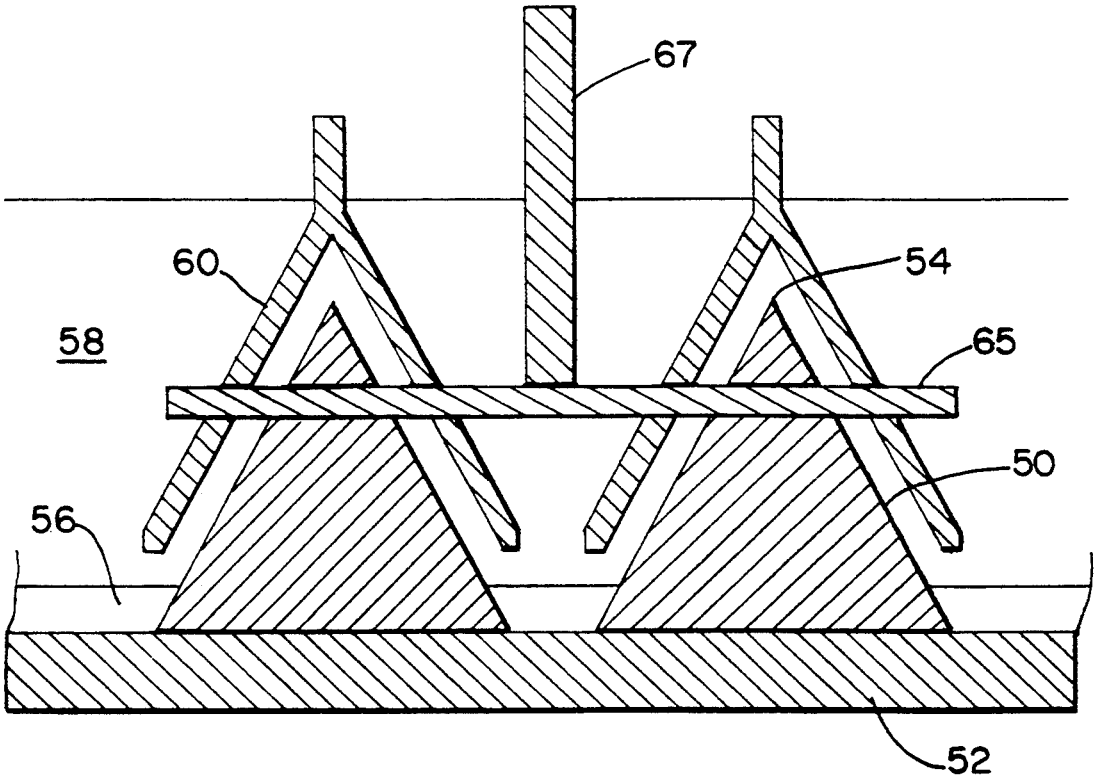
FIG. 4 is a schematic drawing of another anode-cathode configuration.

FIG. 4 illustrates an anode-cathode configuration which can be fitted in a conventional aluminum production cell or in a cell of completely new design. In this design, carbon prisms of inverted V shape or wedges 50 are fitted on a carbon cell bottom 52, preferably fixed thereon by bonding when the cell is being built or reconstructed. These carbon wedges 50 have inclined side faces, for instance at an angle of about 45° to 10° to the vertical, meeting along a top ridge 54. The wedges 50 are placed side by side, spaced apart at their bottoms to allow for a shallow pool 56 of aluminum on the cell bottom 52.

The ridges 54, which can be rounded are all parallel to each other across or along the cell and spaced several centimeters below the top level of the electrolyte 58.

The inclined side faces of the wedges 50 can be coated with a permanent dimensionally stable aluminum-wettable coating, preferably one produced by a micropyretic reaction. The application of micropyretic reactions to produce electrodes for electrochemical processes, in particular for aluminum production is the subject of copending U.S. patent applications Ser. No. 07/715,547 filed Jun. 14, 1991 and U.S. Pat. No. 5,217,583 issued Jun. 8, 1993 the contents of which are incorporated herein by reference.

Over the cathode-forming wedges 50 are fitted anodes 60, each formed by a pair of plates which together fit like a roof over the wedges 50, parallel to the inclined surfaces of the wedges 50, providing an anode-cathode spacing of about 10 to 60 mm, preferably 15 to 30 mm. At their tops, the pairs of anode plates 60 are joined together and connected to a positive current supply. Holes are provided towards the top of the anode for better escape of the gas evolved and useful electrolyte circulation. The anode plates 60 are made of or coated with any suitable non-consumable or substantially non-consumable, electronically-conductive material resistant to the electrolyte and to the anode product of electrolysis, which is normally oxygen. For example, the plates may have a metal, alloy or cermet substrate which is protected in use by a cerium-oxyfluoride-based protective coating produced and/or maintained by maintaining a concentration of cerium in the electrolyte, as described in U.S. Pat. No. 4,614,569.

Other refractory surfaces on carbonaceous or refractory substances can be produced by the methods described in co-pending U.S. patent application Ser. No. 07/861,513 (ref MOL0508, filed Apr. 1, 1992) is incorporated herein by reference.

Adjacent pairs of anode plates 60 and their cathode wedges 50 are assembled together as units by an adequate number of horizontal bars 65 of insulating material, suspended from one or more central insulating posts 67. By this means, the entire unit can be removed from and replaced in the cell when required.

In all cases, the current flow is, of course, from anode to cathode through the molten cryolite. In utilizing an anode-cathode double polar electrode assembly of this invention, the voltage and energy efficiency can be singularly improved since the anode-cathode spacing can be minimized and significant numbers of assemblies put together to provide high efficiency while permitting easy removal of the anode-cathode double polar electrode assembly during cell operation from the molten electrolyte and reimmersion therein.

Since no conventional massive carbon anode is required, the electrode assembly of this invention can be significantly lighter in weight than conventional anodes. Further, the materials of fabrication and technique of construction are readily available and can be produced and utilized in large quantities using relatively inexpensive procedures. Since the anode-cathodes double polar electrode assembly can be formed of various configurations, it is available to retrofit existing aluminum production cells with all the advantages set forth herein.

Figure 5:
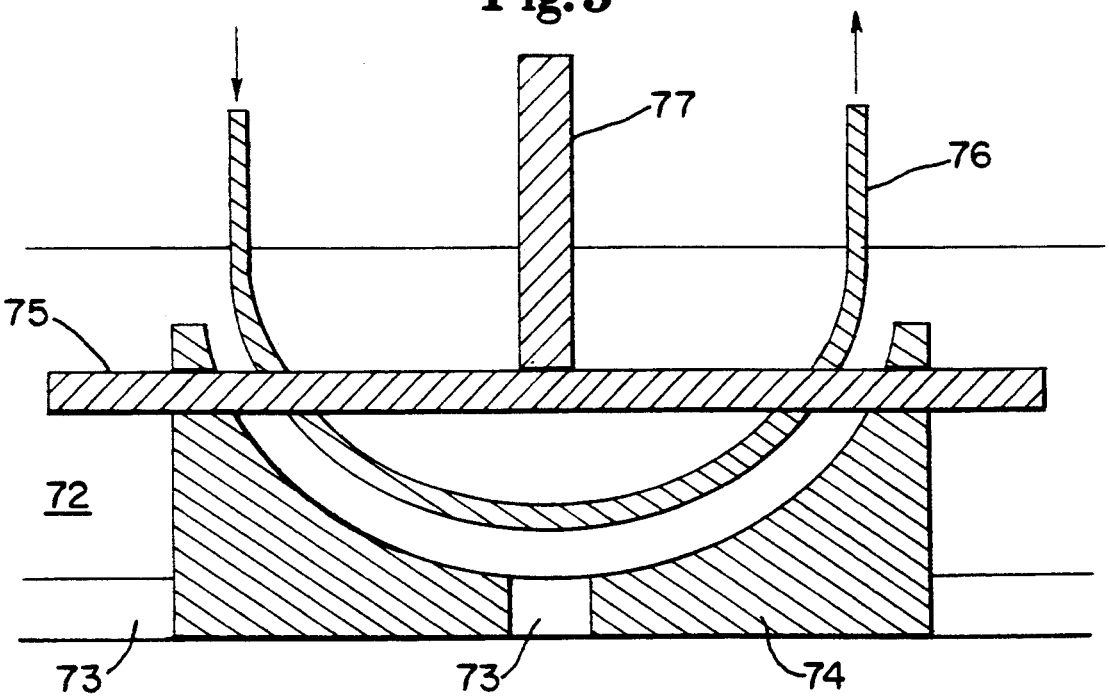
FIG. 5 is a schematic drawing of another configuration where the anode active surface area is continuously replaceable.

FIG. 5 illustrates another embodiment of the invention disclosing a cell trough containing cryolite 72, aluminum 73, an upwardly-curved cathode section 74 and a corresponding downwardly curved anode 76. The cathode has a central opening into which the produced aluminum can drain. The anode 76 can consist of flexible wire or a bundle of flexible wires or can be in the form of a flexible sheet. The anode and cathode are made of materials as previously described herein.

As shown, the anode 76 can be replaced continuously, e.g. by rotation, or at predetermined intervals as desired. The insulating bar 75 in this case has holes for the movement of the anode. This configuration is called the continuous double polar construction.

The insulating bar 75 may be above or below the cryolite line. The insulating bar 75 serves to guide and space the anode(s) 76 from the cathode 74. There can be several insulating bars 75 across the cell, and bars 75 at different levels. By means of the central upwardly projecting post or extension 77, the insulating bars 75 can be lifted out of the cell with its associated anodes 76 and cathode 74, for servicing when required.

Many of these continuous electrode assemblies or units can be set side by side in an electrolytic cell.

It will be understood that the anode-cathode electrode assembly can have other configurations such as cylindrical bodies (or of other shaped open cross section) wherein, e.g. the anodes are formed to surround cathodes which are solid (or hollow) cylinders or of other cross sectional shape.

Further, whatever configuration is used, the anodes and/or cathodes can be provided with cooling means, e.g., internal fluid conduits to contain and permit the flowthrough of coolants.

In the practice of operating a multi-double polar cell for the electrowinning of aluminum, it is one of the advantages of this invention that one anode-cathode unit or a package of anode-cathodes can be removed from the molten electrolyte while the cell is in operation and replaced by another anode-cathode unit or package. This provides a singular improvement over conventional molten cell anode replacement operations. Further, this invention permits monitoring of anode-cathode performance under computer control to permit automatic removal of a faulty anode-cathode package and automatic reimmersion of a new or renovated anode-cathode package.

It is a further feature of this invention that the anode-cathode gap can be maintained constant or made variable, e.g., where any lowering of the electrolyte bath electrical conductivity which occurs due to change in electrolyte bath composition or drop of the operating temperature can wholly or partially be compensated by decreasing the anode-cathode gap within limits permitted by an acceptable current efficiency.

The materials used to form the anode-cathode can be and preferably are, porous, or contain a plurality of holes.

The anodes preferably are substantially non-consumable refractory materials resistant to the oxygen produced and the other gases, vapors and fumes present in the cell, and resistant to chemical attack by the electrolyte.

Useful refractory materials include metals, metal alloys, intermetallic compounds, metal oxyborides, oxides, oxyfluorides, ceramics, cermets and mixtures thereof in the case of the metals, metal alloys, intermetallics and/or metal-oxycompounds, it is preferred that the component metals be selected from at least one of nickel, cobalt, aluminum, copper, iron, manganese, zinc, tin, chromium, lithium, and mixtures in a primary amount, i.e., at least 50% by weight.

In the case of oxides, oxyfluorides, borides, ceramics and cermets, it is preferred that they contain a primary amount, i.e., at least 50% by weight, of at least one of zinc, tin, titanium, zirconium, tantalum, vanadium, lithium, cerium, iron, chromium, nickel, cobalt, copper, yttrium, lanthanides, Misch metals and mixtures thereof.

The cathodes can be formed of or coated with an aluminum-wettable refractory hard metal (RHM) having little or no solubility in aluminum and having good resistance to attack by molten cryolite. Useful RHM include borides of titanium, zirconium, tantalum, chromium, nickel, cobalt, iron, niobium and/or vanadium.

Useful cathode materials also include carbonaceous materials such as anthracite, carbon or graphite.

It is preferred that such a material be coated with a RHM. Further information on RHM coatings is set forth copending in U.S. patent application Ser. No. 07/861,513 (ref. MOL0508, filed on Ap. 1, 1992).

The anode and cathode materials or at lease their surfaces may also contain a small but effective amount of a dopant such as iron oxide, lithium oxide, or cerium oxide to improve their density, electrical conductivity, chemical and electrochemical resistance and other characteristics.

Reference is now made to two examples of specific embodiments of the invention.

EXAMPLE 1

A cell in the new configuration shown in FIG. 1 was run in a small bath an 960° C. containing molten cryolite. The anode plate material was made of a nickel alloy and the cathode plate was made from anthracite coated with a $TiB_2$ coating. The anode and cathode distance in the double polar configuration was kept at 10 mm. Cell voltage was 3.1 V at a current of 1 Amp which translates to a current density of 0.7 Amp/cm$^2$. The anode-cathode double polar assembly is removed after 4 hours, cleaned to regenerate a fresh anode surface, the gap adjusted to 10 mm and the assembly reimmersed. The cell voltage returns to the original value of 3.1 V an the same current. The test of removing and further reimmersion was carried out 24 times to establish the concept of the double polar cell. The insulating bar in this test was made out of alumina.

EXAMPLE 2

An electrode assembly in the configuration of FIG. 3 was made and tried as a anode-cathode double molar electrode assembly. The anode was a solid block of nickel aluminide and the porous cathode was made of $TiB_2$. Stable and constant conditions were noted at a current density of 0.7 Amp/cm$^2$ with an average anode-cathode gap of 15 mm. This system was removed and reimmersed once every hour for 24 hours and a stable and constant cell voltage of 3.4 V was measured each time. The insulating bar in this test was made out of alumina.

In conclusion, it has been shown than new anode-cathode double polar assemblies are possible and advantageous.

We claim:

1. An anode-cathode double-polar electrode assembly comprising one or more anode-cathode electrode assembly units for the production of aluminum by the electrolysis of alumina dissolved in molten halide electrolyte, wherein:

the materials forming the anode and cathode are electrically conductive and the surface or coating of said anodes and cathodes is resistant to the electrolyte and to the products of said electrolysis;

the anode and cathode are held in a spaced part relationship with a gap therebetween, wherein said gap is slightly a 90° angle with respect to the current path in order to balance the voltage drop in different current paths and so as to maintain a more uniform current density over the entire active surface area of the electrodes, said anode-cathode gap is maintained by means of at least one connector element made of material of high electrical, chemical and mechanical resistance; and each said unit is removable from and reimmersible into said molten electrolyte during operation of said assembly for the production of aluminum, whenever the anode or the cathode or any part of the electrode assembly unit needs reconditioning for efficient cell operation.

2. An assembly according to claim 1 wherein the electrical contacts to the anode and cathode of the double-polar electrode assembly unit are both made from the top of the multi double-polar cell.

3. An assembly according to claim 1 wherein the electrical contact to the anode of the double-polar electrode assembly unit is made from the top and that to the cathode is made from the bottom.

4. An assembly according to claim 3 therein the cathode is selected from the group consisting of a carbonaceous material, refractory ceramics, cermet, metal, metal alloy, intermetallic and metal-oxycompound and an adherent refractory coating made of the aluminum-wettable refractory hard metal (RHM).

5. An assembly according to claim 4 wherein the carbonaceous material is selected from the group consisting of anthracite, carbon and graphite.

6. An assembly according to claim 1 wherein the anodes are made of porous material, thereby providing enhanced active surface area, for more efficient evolution and removal of the gas produced and its guided displacement to promote electrolyte circulation in the space between the anode and cathode active surfaces and for enhanced chemical and mechanical resistance.

7. An assembly according to claim 1 wherein the non-conductive connections are made of porous materials to enhance chemical and mechanical resistance.

8. An assembly according to claim 1 wherein the anodes are made of non carbon, substantially non-consumable refractory materials resistant to the electrolyte, to the oxygen produced, and to other gases, vapors, and fumes present in the cell, selected from the group consisting of metals, metal alloys, intermetallic compounds, metal-oxyborides, oxides, oxyfluorides and other metal oxycompounds, ceramics, cermets, and mixtures thereof:

said metals, metal alloys, intermetallic compounds and/or metal-oxycompounds consisting essentially of nickel, cobalt, aluminum, copper, iron, manganese, zinc, tin, chromium and lithium and mixtures thereof; and said oxyborides, oxides, oxyfluorides and other oxycompounds, ceramics and cermets consisting essentially of zinc, tin, titanium, zirconium, tantalum, vanadium, lithium, cerium, iron, chromium, nickel, cobalt, copper, yttrium, lanthanides, and Misch metals and mixtures thereof.

9. An assembly according to claim 1 wherein the anodes comprise an electrically conductive structure and an adherent refractory coating selected from the group consisting of metals, metal alloys, intermetallic compounds and metal-oxyborides, oxides, oxyfluorides and metal oxycompounds other than metal-oxyborides, ceramics, cermets, and mixtures thereof:

said metals, metal alloys, intermetallic compounds and metal-oxycompounds consisting essentially/of nickel, cobalt, aluminum, copper, iron, manganese, zinc, tin, chromium and lithium and mixtures thereof; and said oxyborides, oxides, oxyfluorides and other oxycompounds, ceramics and cermets consisting essentially of zinc, tin, titanium, zirconium, tantalum, vanadium, lithium, cerium, iron, chromium, nickel, cobalt, copper, yttrium, lanthanides, and Misch metals and mixtures thereof.

10. An assembly according to claim 1 wherein the cathodes are made of or coated with an aluminum-wettable refractory hard metal (RHM) resistant to attack by molten cryolite, said RHM being a boride of a metal selected from the group consisting of titanium, zirconium, tantalum, chromium, nickel, cobalt, iron, niobium, and vanadium and mixtures thereof.

11. An assembly according to claim 8 or 10, wherein doping agents are added to the refractory materials used to improve their density, electrical conductivity, chemical and electrochemical resistance.

12. An assembly according to claim 1 wherein said connector is made of an electrically non-conductive material resistant to the electrolyte and to the products of electrolysis, the material is selected from the group consisting of silicon nitride, aluminum nitride, nitrides other than silicon and aluminum nitride, alumina, oxides other than alumina and oxynitrides.

13. An assembly according to claim 1 wherein at least one of the anode, cathode and the connector element is made of or coated with a refractory material obtained by micropyretic self-sustaining reaction.

14. An assembly according to claim 13 wherein the micropyretic reactions is carried out utilizing slurries.

15. An assembly according to claim 14 wherein the slurries contain reactants and non-reactant fillers.

16. An assembly according to claim 15 wherein the non-reactant fillers contain particulate powders made of materials obtainable by the micropyretic reaction.

17. An assembly according to claim 1 wherein all anodes and all cathodes are connected in parallel inside or outside of the cell.

18. An assembly according to claim 1 wherein the anodes and the cathodes have the shape of plates.

19. An assembly according to claim 1 wherein the anodes are substantially cylindrical hollow bodies and the cathodes are rods placed inside such bodies.

20. An assembly according to claim 1 wherein the anodes have the shape of an inverted V and the cathodes have the shape of a prism placed inside the anodes.

21. A method of operating an anode-cathode double-polar electrode assembly comprising one or more anode-cathode electrode assembly units for the production of aluminum by the electrolysis of alumina dissolved in molten halide electrolyte, wherein the materials forming the anode and cathode are electrically conductive and the surface or coating of said anodes and cathodes is resistant to the electrolyte and to the electrolysis, the anode and cathode are held in a spaced part relationship with a constant gap therebetween, each said unit is removable from and reimmersible into said molten electrolyte during operation of said assembly for the production of aluminum, the method comprising the steps of:

removing any of said units during operation of the multi double-polar cell whenever the anode or the cathode or any part of said unit needs reconditioning for efficient cell operation; and reimmersing said unit after reconditioning into said assembly to continue normal operating conditions.

22. The method of claim 21 comprising the further step of:

compensating at least in part, any lowering of bath electrical conductivity due to change in bath composition or lowering of the operating temperatures, by decreasing the anode-cathode gap to an extent, to maintain an acceptable current efficiency.

23. The method of claim 21 comprising the further step of:

eliminating or substantially reducing the emission of $CO_2$.

24. The method of claim 21 comprising the further step of:

regulating by computerized checking, the operating conditions of said units; and automatically executing the removal of any said unit requiring reconditioning.

25. The method of claim 21, wherein each said unit comprises:

at least two anodes and at least one cathode connected to permit electrical current flow therebetween.

26. The method of claim wherein said assembly comprises at least two units.

27. The method of claim 21 wherein:

the anode of each said unit is provided with cooling means; or the cathode of each said unit is provided with cooling means; or the anode and the cathode are both provided with cooling means.

28. The method of claim 21 wherein:

the anode active surface area of each said unit is continuously replaceable during the operation of said unit.

29. The method of claim 21 wherein said anode and cathode of each said unit are held by at least one connector element in spaced-apart relationship with a substantially constant gap therebetween;

the anode and the cathode are made of or coated with electrically conductive materials resistant to the electrolyte and to the products of electrolysis; and the connector element is made of material of high electrical, chemical and mechanical resistance

30. The method of claim 21 wherein the electrical contacts to the anode and cathode of the double-polar electrode assembly unit are both made from the top of the multi double-polar cell.

31. The method of claim 21 wherein the electrical contact to the anode of the double-polar electrode assembly unit is made from the top and that to the cathode is made from the bottom.

32. The method of claim 21 wherein the anodes are made of porous material, thereby providing enhanced active surface area, for more efficient evolution and removal of the gas produced and its guided displacement so as to promote electrolyte circulation in the space between the anode and cathode active surfaces and for enhanced chemical and mechanical resistance.

33. The method of claim 21 wherein the non-conductive connections are made of porous materials to enhance chemical and mechanical resistance.

34. The method of claim 21 wherein the anodes are made of non carbon, substantially non-consumable refractory materials resistant to the electrolyte, to the oxygen produced, and to other gases, vapors, and fumes present in the cell, selected from the group consisting of metals, metal alloys, intermetallic compounds, metal-oxyborides, oxides, oxyfluorides and other metal oxycompounds, ceramics, cermets, and mixtures thereof:

said metals, metal alloys, intermetallic compounds and/or metal-oxycompounds consisting essentially of nickel, cobalt, aluminum, copper, iron, manganese, zinc, tin, chromium and lithium and mixtures thereof; and said oxyborides, oxides, oxyfluorides and other oxycompounds, ceramics and cermets consisting essentially of zinc, tin, titanium, zirconium, tantalum, vanadium, lithium, cerium, iron, chromium, nickel, cobalt, copper, yttrium, lanthanides, and Misch metals and mixtures thereof.

35. The method of claim 21 wherein the anodes comprise an electrically conductive structure and an adherent refractory coating selected from the group consisting of metals, metal alloys, intermetallic compounds and metal-oxyborides, oxides, oxyfluorides and metal oxycompounds other than metal-oxyborides, ceramics, cermets, and mixtures thereof:

said metals, metal alloys, intermetallic compounds and metal-oxycompounds consisting essentially of nickel, cobalt, aluminum, copper, iron, manganese, zinc, tin, chromium and lithium and mixtures thereof; and said oxyborides, oxides, oxyfluorides and other oxycompounds, ceramics and cermets consisting essentially of zinc, tin, titanium, zirconium, tantalum, vanadium, lithium, cerium, iron, chromium, nickel, cobalt, copper, yttrium, lanthanides, and Misch metals and mixtures thereof.

36. The method of claim 21 wherein the cathodes are made of or coated with an aluminum-wettable refractory hard metal (RHM) resistant to attack by molten cryolite, said RHM being a boride of a metal selected from the group consisting of titanium, zirconium, tantalum, chromium, nickel, cobalt, iron, niobium, and vanadium and mixtures thereof.

37. The method of claim 36 wherein the cathode is selected from the group consisting of a carbonaceous material, refractory ceramics, cermet, metal, metal alloy, intermetallic and metal-oxycompound and an adherent refractory coating made of the aluminum-wettable refractory hard metal (RHM).

38. The method of claim 37 wherein the carbonaceous material is selected from the group consisting of anthracite, carbon and graphite.

39. The method of claim 34 or 36 wherein doping agents are added to the refractory materials used to improve their density, electrical conductivity, chemical and electrochemical resistance and other characteristics.

40. The method of claim 36 wherein the connector is made of an electrically non-conductive material resistant to the electrolyte and to the products of electrolysis, the material is selected from the group consisting of silicon nitride, aluminum nitride, nitrides other than silicon and aluminum nitride, alumina, oxides other than alumina and oxynitrides.

41. The method of claim 21 wherein the at least one of the anode, cathode and the connector element is made of or coated with a refractory material obtained by micropyretic self-sustaining reaction.

42. The method of claim 41 wherein the micropyretic reaction is carried out utilizing slurries.

43. The method of claim 42 wherein the slurries contain reactants and non-reactant fillers.

44. The method of claim 43 wherein the non-reactant fillers contain particulate powders made of materials obtainable by the micropyretic reaction.

45. The method of claim 21 wherein all anodes and all cathodes are connected in parallel inside or outside of the cell.

46. The method of claim 21 wherein the anodes and the cathodes have the shape of plates.

47. The method of claim 21 wherein the anodes are substantially cylindrical hollow bodies and the cathodes are rods placed inside such bodies.

48. The method of claim 21 wherein the anodes have the shape of an inverted V and the cathodes have the shape of a prism placed inside the anodes.

* * * * *

UNITED STATES PATENT AND TRADEMARK OFFICE

CERTIFICATE OF CORRECTION

PATENT NO. : 5,362,366

DATED : November 8, 1994

INVENTOR(S) : de Nora et al.

It is certified that error appears in the above-identified patent and that said Letters Patent is hereby corrected as shown below:

Column 9 - Claim 1, line 59, between "slightly" and "a", insert --changed along a line at--.
Column 9 - Claim 1, line 60, delete "in order"
Column 9 - Claim 1, line 61, delete "so as"
Column 10 - Claim 4, line 13, "therein" should be deleted and replaced with --wherein--
Column 10 - Claim 8, line 43 - "and/or" should be deleted and replaced with --and--
Column 10 - Claim 9, line 61 - "/" after the word "essentially" and before the word "of" should be deleted
Column 11 - Claim 21, line 51 - after the words "to the" and before the word "electrolysis" insert --products of said--
Column 11 - Claim 22, line 68 "temperatures" should be "temperature"
Column 12 - Claim32, line 53 after the word "displacement" delete --so as--
Column 12 - Claim 34 line 68 "and/or" should be deleted and replaced with --and--
Column 13 - Claim 36, line 33 - "being" should be deleted and replaced with --is--

UNITED STATES PATENT AND TRADEMARK OFFICE

CERTIFICATE OF CORRECTION

PATENT NO. : 5,362,366

DATED : November 8, 1994

INVENTOR(S) : Vittorio De Nora, et al.

It is certified that error appears in the above-indentified patent and that said Letters Patent is hereby corrected as shown below:

Column 14 - Claim 39, line 9-10 "and other characteristics" should be deleted

Signed and Sealed this

Ninth Day of May, 1995

Bruce Lehman

*Attest:*

BRUCE LEHMAN

*Attesting Officer*

*Commissioner of Patents and Trademarks*